US006928808B2

(12) United States Patent
Hahn et al.

(10) Patent No.: US 6,928,808 B2
(45) Date of Patent: Aug. 16, 2005

(54) DEVICE AND METHOD FOR CONTROLLING THE NOX REGENERATION OF A NOX STORAGE CATALYST

(75) Inventors: Hermann Hahn, Hannover (DE); Sören Hinze, Braunschweig (DE)

(73) Assignee: Volkswagen Atkiengesellschaft, Wolfsburg (DE)

( * ) Notice: Subject to any disclaimer, the term of this patent is extended or adjusted under 35 U.S.C. 154(b) by 123 days.

(21) Appl. No.: 10/203,852

(22) PCT Filed: Jan. 12, 2001

(86) PCT No.: PCT/EP01/00336

§ 371 (c)(1),
(2), (4) Date: Aug. 27, 2002

(87) PCT Pub. No.: WO01/61173

PCT Pub. Date: Aug. 23, 2001

(65) Prior Publication Data

US 2003/0089103 A1 May 15, 2003

(30) Foreign Application Priority Data

Feb. 17, 2000 (DE) ..... 100 07 149

(51) Int. Cl.[7] ..... F01N 3/00

(52) U.S. Cl. ..... 60/295; 60/274; 60/285; 60/297

(58) Field of Search ..... 60/274, 285, 284, 60/286, 295, 297, 301

(56) References Cited

U.S. PATENT DOCUMENTS

| | | | | | |
|---|---|---|---|---|---|
| 5,437,153 | A | * | 8/1995 | Takeshima et al. | 60/276 |
| 5,483,795 | A | * | 1/1996 | Katoh et al. | 60/276 |
| 5,992,142 | A | * | 11/1999 | Pott | 60/274 |
| 6,021,638 | A | * | 2/2000 | Hochmuth | 60/274 |
| 6,173,571 | B1 | * | 1/2001 | Kaneko et al. | 60/286 |
| 6,568,177 | B1 | * | 5/2003 | Surnilla | 60/285 |

FOREIGN PATENT DOCUMENTS

| | | |
|---|---|---|
| DE | 197 16 275 | 9/1998 |
| DE | 197 58 018 | 7/1999 |
| DE | 198 28 609 | 12/1999 |

* cited by examiner

*Primary Examiner*—Binh Q. Tran
(74) *Attorney, Agent, or Firm*—Norris, McLaughlin & Marcus, PA

(57) ABSTRACT

The invention relates to a method and device for controlling the $NO_x$ regeneration of a $NO_x$ storage catalyst (14) disposed in the exhaust gas train (12) of an internal combustion engine (10) of a motor vehicle. The $NO_x$ regeneration is at least initiated when a threshold value is exceeded for a load state of a $NO_x$ storage catalyst (14) or a $NO_x$ emission downstream from the $NO_x$ storage catalyst (14). According to the invention, it is detected (a) whether the internal combustion engine (10) is idling and (b) alternately or in any possible combination, the threshold value for the load state or the $NO_x$ emission is increased; the $NO_x$ regeneration is only initiated after a specific amount of time has elapsed and a current $NO_x$ regeneration is interrupted when a shift occurs into an idling mode.

9 Claims, 1 Drawing Sheet

DEVICE AND METHOD FOR CONTROLLING THE NOX REGENERATION OF A NOX STORAGE CATALYST

BACKGROUND OF THE INVENTION

The invention relates to a method and device for controlling the $NO_x$ regeneration of a $NO_x$ storage catalyst located in the exhaust gas channel of an internal combustion engine of a motor vehicle and having the features recited in the preambles of the independent claims.

It is known to integrate an exhaust gas cleaning device in the exhaust gas channel for the purpose of cleaning the exhaust of internal combustion engines. The exhaust gas cleaning device typically includes components such as a particle filters or catalysts. If a raw emission of $NO_x$ of the internal combustion engine is to be reduced, then these catalysts include a reduction catalyst. If the mass flows of reducing pollutants, such as carbon monoxide CO and incompletely combusted carbohydrides CH are sufficiently large in the region of the reduction catalyst, then the reducing agent $NO_x$ promotes a conversion to nitrogen.

To minimize fuel consumption, it has proven to be advantageous to operate the internal combustion engine under the lean air conditions. However, the operation in the range optimized for fuel consumption is associated, on one hand, with increased $NO_x$ emission and, on the other hand, with reduced mass flows of reducing agents. To prevent high $NO_x$ emission levels, a $NO_x$ storage device is associated with the catalyst which absorbs the $NO_x$ in form of a nitrate. The $NO_x$ storage device can be combined with the catalyst as a so-called $NO_x$ storage catalyst.

The mass storage capacity of the $NO_x$ storage catalyst is, of course, limited, so that a $NO_x$ regeneration has be performed in regular intervals to prevent $NO_x$ breakthroughs. During the $NO_x$ regeneration, the operating mode changes to stoichiometric or rich. The $NO_x$ that had been absorbed in the form of nitrate is thereby released. Typically, a $NO_x$ regeneration is initiated when a threshold value for a load state of the $NO_x$ storage catalyst or a $NO_x$ emission detected downstream by a $NO_x$-sensitive measuring device (breakthrough emission) is exceeded. This has the disadvantage that identical criteria are applied for all operating phases of the motor vehicle to determine the need for regeneration. However, if the $NO_x$ regeneration is initiated in the idle phase, significantly less exhaust gas flows and therefore the mass flows of reducing agents that are present are also smaller, so that the desorbed $NO_x$ can only be incompletely reduced on the catalyst component. $NO_x$ regeneration during the idle phase does not only result in an undesirably high $NO_x$ emission, but also leads to increased fuel consumption as compared to other operating phases where the internal combustion engine runs under higher load. Disadvantageous, the $NO_x$ regeneration in the idle phase is frequently also accompanied by generation of undesirable noise. Moreover, $NO_x$ regeneration under idle conditions takes longer due to the smaller exhaust gas flows, and the operating conditions with unfavorable fuel consumption must be maintained for a longer time.

SUMMARY OF THE INVENTION

It is an object of the present invention to provide a method and a device which can obviate the aforedescribed disadvantages of the conventional technology. The obtained solution should be easily integratable with proven process control models.

The object is solved according to the invention by the device and method for controlling the $NO_x$ regeneration of the $NO_x$ storage catalyst having the characterizing features recited in the independent claims. For example, a lean phase in idle mode can be extended to the next absolutely essential $NO_x$ regeneration or can be controlled with this method according to the predetermined time intervals by:

(a) determining if an internal combustion engine is switched into an idle mode, and (b) alternatively or in any combination
- increasing in the idle mode the threshold value for the load state or the $NO_x$ emission,
- initiating the $NO_x$ regeneration after predetermined time intervals have passed, and
- interrupting a current $NO_x$ regeneration when changing into the idle mode.

The device according to the invention includes means for carrying out the aforedescribed method steps. Such means is preferable a control device in which a procedure is stored in digitized form which enables control of the $NO_x$ regeneration in idle mode. The control device can be implemented as an independent control unit or can be integrated into an often already existing engine controller.

If a $NO_x$ regeneration is performed during a change into the idle mode, then the $NO_x$ regeneration is preferably completed, if the change into the idle mode occurs in a fuel-cutoff phase, if a rotation speed exceeds a predetermined threshold value or a motor vehicle speed also exceeds a predetermined limit speed. If the $NO_x$ regeneration is interrupted, then a marker is set which causes the $NO_x$ regeneration to continue in a subsequent acceleration phase. Of course, the marker is removed if a $NO_x$ regeneration had to be already performed in the idle mode.

Preferably, the $NO_x$ regeneration is performed by setting a lambda value in the range between 0.85 to 1.0. In any event, the $NO_x$ regeneration should be performed under less rich conditions than is otherwise typical for $NO_x$ regenerations. In this way, the noise level can be reduced in comparison to the "normal" $NO_x$ regeneration at lambda values that are typically significantly less than 0.85. According to another preferred embodiment of the method, a $NO_x$ regeneration in idle mode is always initiated if for any reason a change into a $\lambda=1$ operation is required. This can be the case, for example, when the pressure in a brake booster should be increased.

Generally, the aforedescribed procedures can reduce the number of $NO_x$ regenerations in idle mode as compared to the other operating phases of the motor vehicle, so that fuel consumption, $NO_x$ emission during the $NO_x$ regeneration, as well as the noise generation are reduced.

Additional preferred embodiments of the invention are disclosed as additional features in the dependent claims.

BRIEF DESCRIPTION OF THE DRAWINGS

The invention will now be described in detail with reference to an embodiment illustrated in the appended drawings. It is shown in.

DETAILED DESCRIPTION OF THE PREFERRED EMBODIMENTS

Figure 1:
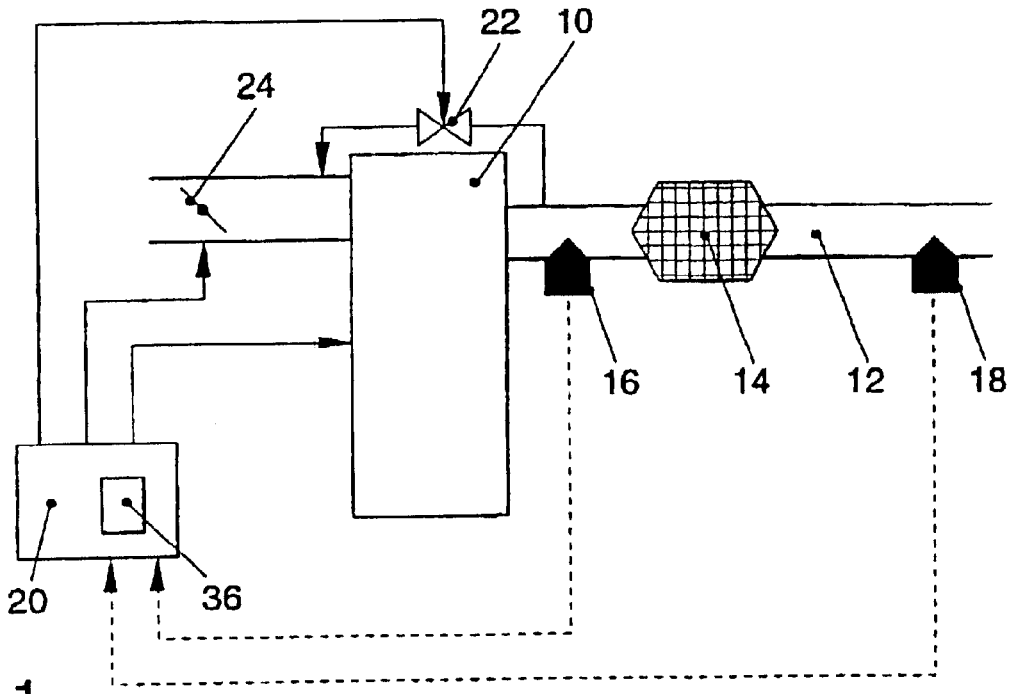
FIG. 1 a schematic diagram of an internal combustion engine with a $NO_x$ storage catalyst arranged in the exhaust gas channel, and FIG. 2 a schematic block diagram for controlling a $NO_x$ regeneration of the $NO_x$ storage catalyst in idle mode.

FIG. 1 shows an internal combustion engine 10 with a $NO_x$ storage catalyst 14 arranged downstream in the exhaust channel 12. Associated with the exhaust gas channel 12 is a suitable sensor circuitry for measuring the air conditions in the exhaust or the fractions of specific pollutants. For example, a gas sensor 16 can be provided as a lambda probe or a gas sensor 18 as a $NO_x$-sensitive measuring device. The data measured by the sensor circuitry are supplied in a known manner in a motor controller 20. Models are stored in the motor controller 20 in digitized form for determining regulated values for the components associated with the internal combustion engine 10. The components enable control of an air-fuel ratio, an ignition angle or an injected fuel quantity in the combustion process. For example, regulated values can represent an opening angle of an exhaust return valve 22 or a position of a throttle 24. The device and the method for regulating the combustion process are sufficiently known and are therefore not described in detail at this place.

In addition, other status parameters, for example a flap position of a throttle or a gas pedal angle are inputted into the motor controller 20, which can be used to determine in a known manner if the motor vehicle is idling. The status of the motor vehicle is subsequently read into a control device 36 which is implemented in the motor controller 20.

If an excess of oxygen is present during the combustion process of an air-fuel mixture, a raw emission of $NO_x$ of the internal combustion engine 10 increases, while at the same time the quantity of reducing agents carbon monoxide CO and incompletely combusted carbohydrides CH, which are required for converting $NO_x$, decreases. Since this operating range has proven to have a particularly advantageous fuel consumption, the $NO_x$ has to be absorbed in a storage component of the $NO_x$ storage catalyst 14 to prevent $NO_x$ emission. If the operating mode changes into a stoichiometric or rich mode, then the $NO_x$, which is stored in form of nitrate, is desorbed again very quickly, at least immediately after the atmosphere in the $NO_x$ storage catalyst 14 changes. If the mass flows of reducing agents are too low, then the reducing agents cannot be supplied in sufficient quantity to the catalyst component of the $NO_x$ storage catalyst, which can cause undesirable $NO_x$ emission.

Figure 2:
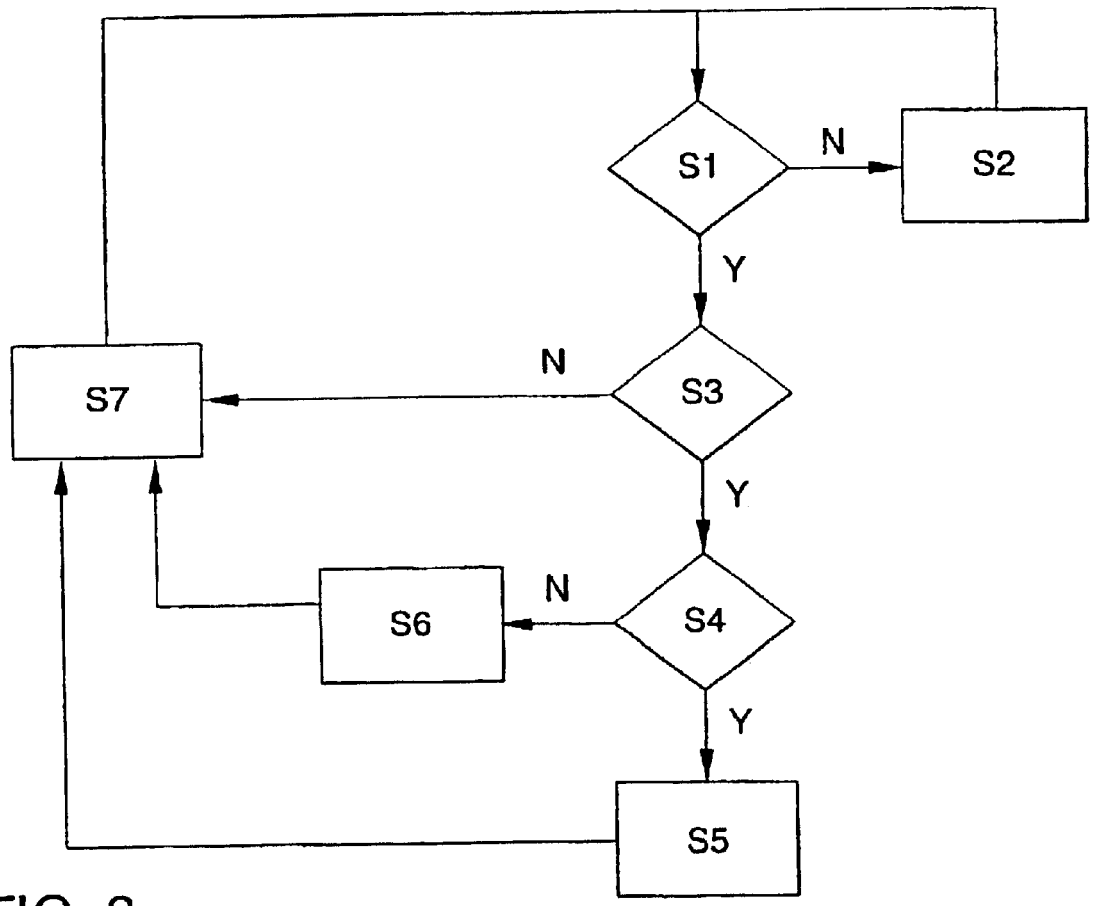

With the method described hereinafter (see FIG. 2), the lean operating mode can be maintained longer under idle conditions which typically have lower exhaust gas flows, which reduces the number of $NO_x$ regenerations in the idle mode in comparison to other operating phases. Moreover, noise generation caused by the $NO_x$ regeneration can be suppressed.

First, it is determined in an initial query if the motor vehicle is idling (step S1). If this is not the case, then the $NO_x$ regeneration of the $NO_x$ storage catalyst 14 can be controlled by a conventional process. For example, a load state of the $NO_x$ storage catalyst 14 or a $NO_x$ emission downstream of the $NO_x$ storage catalyst 14 can be monitored (step S2). If this quantity exceeds a threshold value, the $NO_x$ regeneration is initiated by changing into the stoichiometric or rich operation.

If the motor vehicle is idling, then it is determined in a subsequent query (step S3), if the change into the idle mode occurs during an ongoing $NO_x$ regeneration. If this is affirmative, then it is determined in step S4, if a fuel cutoff phase exists and/or if the motor vehicle still has a speed above a predetermined limit speed, and/or if a rotation speed exceeds a predetermined threshold value. If these boundary conditions are fulfilled, then the $NO_x$ regeneration is first completed (step S5). Otherwise, the current $NO_x$ regeneration is interrupted and a marker is set (step S6). Setting this marker ensures that the $NO_x$ regeneration is resumed at the end of the idle phase, for example in a subsequent acceleration phase of the motor vehicle.

After the steps S5and S6or if the change into the idle mode does not occur during an ongoing $NO_x$ regeneration (step S3), new threshold values for determining the need for regeneration are set (step S7). The threshold values which are used with conventional processes for the load state and/or the $NO_x$ emission are then increased. It will be understood that the values have to be set in a manner that no significant $NO_x$ breakthroughs can occur during in idle mode, which due to the low exhaust gas mass flows can be guaranteed even if the threshold values are higher than for the other operating phases of the internal combustion engine 10.

As an alternative to the latter approach, a fixed time interval can be set in step S7, wherein the $NO_x$ regeneration has to be performed at the end of this time interval. Advantageously, in addition to the aforedescribed approach for controlling the $NO_x$ regeneration in idle mode, the airfuel ratio during the $NO_x$ regeneration can be set to a value in a range of $\lambda$=0.85 to 1.0, and at least less rich than is otherwise typical for $NO_x$ regenerations, which reduces the noise generation.

LIST OF REFERENCE NUMERALS

10 internal combustion engine
12 exhaust gas channel
14 $NO_x$ storage catalyst
16 gas sensor
18 gas sensor
20 engine controller
22 exhaust gas return valve
24 throttle flap
36 control device

What is claimed is:

1. Method for controlling a $NO_x$ regeneration of a $NO_x$ storage catalyst (14) arranged in an exhaust gas channel (12) of an internal combustion engine (10) for motor vehicles, wherein the $NO_x$ regeneration is initiated at least when a threshold value for a load state of the $NO_x$ storage catalyst (14) or a threshold value for a $NO_x$ emission downstream of the $NO_x$ storage catalyst (14) is exceeded, the method comprising the steps of:

(a) determining if the internal combustion engine (10) is operating in an idle mode, and (b) performing at least one of the following steps for extending a lean operation in the idle mode if the determination is that the engine is operating in the idle mode:

increasing the threshold value for the load state of the $NO_x$ storage catalyst, increasing the threshold value for the $NO_x$ emission, initiating the $NO_x$ regeneration after a predetermined time interval has passed, and interrupting a current $NO_x$ regeneration.

2. Method according to claim 1, wherein a current $NO_x$ regeneration is not interrupted when changing into the idle mode, if a fuel cut-off phase occurs, if a motor vehicle speed exceeds a predetermined limit speed or if a rotation speed exceeds a predetermined threshold value.

3. Method according to claim 2, wherein if a current $NO_x$ regeneration is interrupted, a marker is set which causes the $NO_x$ regeneration to be continued in a subsequent acceleration phase of the motor vehicle.

4. Method according to claim 3, wherein the marker is removed if a $NO_x$ regeneration already had to be performed in idle mode.

5. Method according to claim 1, wherein the $NO_x$ regeneration is performed in idle mode by setting a lambda value in a range of 0.85 to 1.0, but in any event less rich than is otherwise typical for $NO_x$ regeneration.

6. Method according to claim 1, wherein the $NO_x$ regeneration is initiated during the idle mode when a change into a $\lambda$=1 operation is required.

7. Device for controlling a $NO_x$ regeneration of a $NO_x$ storage catalyst (14) arranged in an exhaust gas channel (12) of an internal combustion engine (10) for motor vehicles, wherein the $NO_x$ regeneration is initiated at least when a threshold value for a load state of the $NO_x$ storage catalyst (14) or a threshold value for a $NO_x$ emission downstream of the $NO_x$ storage catalyst (14) is exceeded, wherein the device comprises a means for determining if an internal combustion engine (10) is operating in an idle mode, and wherein, if the means determines that the engine is operating in the idle mode, the means performs at least one of the following steps for extending a lean engine operation in the idle mode:

increasing the threshold value for the load state of the $NO_x$ storage catalyst, increasing the threshold value for the $NO_x$ emission, initiating the $NO_x$ regeneration after a predetermined time interval has passed, and interrupting a current $NO_x$ regeneration.

8. Device according to claim 7, wherein the means comprises a control device (36), in which control device a procedure is stored in digitized form for controlling the $NO_x$ regeneration of the $NO_x$ storage catalyst (14) in idle mode.

9. Device according to claim 8, wherein the control device (36) is integrated in an engine controller (20).

* * * * *